US005781840A

United States Patent [19]

Chen et al.

[11] Patent Number: 5,781,840

[45] Date of Patent: Jul. 14, 1998

[54] PROCESS FOR FUSING A TONER IMAGE TO A SUBSTRATE USING A WICKING AGENT

[75] Inventors: Jiann H. Chen, Fairport; Tsang J. Chen, Rochester; Ricki W. Burger, Penfield, all of N.Y.

[73] Assignee: Eastman Kodak Company, Rochester, N.Y.

[21] Appl. No.: 761,254

[22] Filed: Dec. 6, 1996

[51] Int. Cl.[6] ..... G03G 15/20

[52] U.S. Cl. ..... 399/324; 399/333; 430/97

[58] Field of Search ..... 399/320, 324, 399/325, 333, 321, 33; 430/99, 97, 337, 36.8; 428/421, 447

[56] References Cited

U.S. PATENT DOCUMENTS

| | | | |
|---|---|---|---|
| 4,029,827 | 6/1977 | Imperial et al. . | |
| 4,101,686 | 7/1978 | Strella et al. . | |
| 4,185,140 | 1/1980 | Strella et al. . | |
| 4,257,699 | 3/1981 | Lentz . | |
| 4,264,181 | 4/1981 | Lentz et al. . | |
| 4,272,179 | 6/1981 | Seanor . | |
| 4,372,246 | 2/1983 | Azar et al. . | |
| 4,659,621 | 4/1987 | Finn et al. . | |
| 4,711,818 | 12/1987 | Henry . | |
| 5,141,788 | 8/1992 | Badesha et al. . | |
| 5,157,445 | 10/1992 | Shoji et al. | 399/325 |
| 5,250,996 | 10/1993 | Sugizaki et al. | 399/321 |
| 5,327,202 | 7/1994 | Nami et al. | 399/333 |
| 5,401,570 | 3/1995 | Heeks et al. . | |

OTHER PUBLICATIONS

Henry and Lee, "Improving Release Performance of Viton Fuser Rolls," *Xerox Disclosure Journal*, vol. 9, No. 1, 1984.

R. Anderson et al., *Silicon Compounds Register and Review*, Petrarch Systems, 1987, pp. 266–270.

*Primary Examiner*—S. Lee

*Attorney, Agent, or Firm*—Doreen M. Wells

[57] ABSTRACT

A process for fusing a toner image to a substrate includes applying to a fuser member a replenishable layer containing a controlled amount of a wicking agent; the fuser member surface sites reactive to binding with Si—H functional groups included in an organopolysiloxane. The wicking agent have an organopolysiloxane having Si—H functional groups and at least about $1\times10^{-6}$ weight percent of a metal compound that is effective for promoting reaction between the reactive sites on the fuser member surface and the Si—H functional groups of the organopolysiloxane. The toner image is contacted with a substrate at a temperature sufficient to fuse the toner image to the substrate.

28 Claims, No Drawings

PROCESS FOR FUSING A TONER IMAGE TO A SUBSTRATE USING A WICKING AGENT

FIELD OF THE INVENTION

This invention relates in general to electrostatographic imaging and in particular to the fusing of toner images. More specifically, this invention relates to a process for fusing a toner image to a substrate by applying an improved wicking agent to a fuser member.

BACKGROUND OF THE INVENTION

In certain electrostatographic imaging and recording processes such as electrophotographic copying processes, an electrostatic latent image formed on a photoconductive surface is developed with a thermoplastic toner powder which is thereafter fused to a receiver. The fusion step commonly involves directly contacting the substrate, such as a sheet of paper on which toner powder is distributed in an imagewise pattern, with a heated fuser member such as a fuser roller. In most instances, as the powder image is tackified by heat, part of the image carried by the sheet sticks to the surface of the roller so that as the next sheet is advanced, the tackified image partially removed from the first sheet partly transfers to the next sheet and at the same time part of the tackified image from the next sheet adheres to the fuser roller. Any toner remaining adhered to the heated surface can cause a false offset image to appear on the next sheet that contacts the fuser roller and can also degrade the fusing performance of the surface of the member fuser.

To prevent toner offset, many expedients have been tried, for example, providing the fusing roller with an abhesive surface such as a thin coating of an elastomer, e.g., a fluoroelastomer, or a silicone polymer of low surface energy. Also polymeric wicking agents, e.g., polydiorganosiloxane compounds such as, for example, polydimethylsiloxane oils, have been applied to the fuser roller surface during the operation of the fusing member. U.S. Pat. Nos. 4,264,181 and 4,272,179 describe fuser rollers having surfaces comprising fluoroelastomers and metal-containing fillers and providing sites that react with functionalized polymeric wicking agents such as mercapto-functional polydiorganosiloxanes to form surfaces abhesive to toner materials, thereby reducing toner offset. Unfortunately, as such fuser rollers wear, fresh active sites that are exposed react not only with the functionalized polymeric agents but also with various components of the toner materials and the paper substrate. Such reaction builds up debris on the surface of the fuser roller, resulting in permanent damage to the surface and greatly reducing the life of the fuser roller. Additionally, the metal-containing filler particles are physically torn from the fuser surface during use, which also reduces the life of the fuser roll. Use of mercapto-functional polydiorganosiloxane wicking agents is also undesirable because of concerns relating to toxicity and unpleasant odors.

U.S. Pat. Nos. 4,029,827, 4,101,686 and 4,185,140 also describe the use of functionalized polymeric wicking agents with heated fuser members.

U.S. Pat. No. 5,401,570 discloses a fuser roller having a silicone rubber layer containing a filler component that reacts with a silicone hydride release oil.

SUMMARY OF THE INVENTION

In accordance with the invention, a process for fusing a toner image to a substrate comprises applying to a fuser member a replenishable layer containing a controlled amount of a wicking agent. The fuser member surface has sites that are reactive to binding with Si—H functional groups included in an organopolysiloxane. The wicking agent comprises an provides a wicking agent for application to a fuser member. The wicking agent comprises an organopolysiloxane having Si—H functional groups and at least about $1\times10^{-6}$ weight percent of a metal compound that is effective for promoting reaction between the reactive sites on the fuser member surface and the Si—H functional groups of the organopolysiloxane. Pressure contacting a toner image with a substrate while heating fuses the toner image to the substrate.

The metal compound promotes reaction between the Si—H functional groups of the organopolysiloxane and active sites on the surface of the fuser member. The reaction between the fuser member surface and the wicking agent organopolysiloxane improves the release performance of the fuser member, decreases toner offset, reduces wear, and extends the life of the fuser member while avoiding the odor problems associated with the use of mercapto-functionalized fluids. Further, unlike the prior art, it is not required to incorporate metal-containing fillers in the surface layer of the fuser member.

DESCRIPTION OF THE PREFERRED EMBODIMENTS

A wicking agent is applied to fuser members present in the fusing system of an electrostatographic machine or the like. The wicking agent can be applied to the fuser member surface during copying, either continuously or discontinuously but preferably continuously, to provide a replenishable release layer to prevent toner offset and protect the surface layer of the fuser member. The preferred rate of application of the wicking agent to the fuser member is about 1 to 10 mg/copy, more preferably about 2 mg/copy.

The functionalized organopolysiloxane with Si—H functional groups included in the wicking agent of this invention can be represented by the formula:

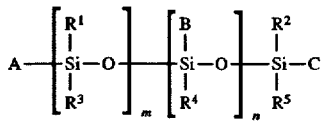

wherein $R^1$, $R^2$, $R^3$, $R^4$, and $R^5$, are independently selected from the group consisting of alkyl containing 1 to 10 carbon atoms, cycloalkyl containing 5 to 10 carbon atoms, alkoxy containing 1 to 10 carbon atoms, and phenyl; $R^1$, $R^2$, $R^3$, $R^4$, and $R^5$ are preferably alkyl containing 1 to 5 carbon atoms, most preferably methyl. A, B and C are independently selected from the group consisting of hydrogen, alkyl containing 1 to 10 carbon atoms, and alkoxy containing 1 to 10 carbon atoms, with the proviso that at least one of A, B or C is hydrogen, preferably, B being H and, more preferably, B being H and A and C each being alkyl. Also in the formula, m and n represent percentages, each in the range of 1 to 99 percent.

Specific examples of commercially available Si—H functionalized polyorganosiloxanes of utility in this invention, all of which are available from Petrarch Systems, Bristol Pa., include:

(1) polymethylhydrosiloxanes such as PS-119, PS-120 and PS-122;

(2) hydride-terminated polydimethylsiloxanes such as PS-542, PS-543 and PS-545; and (3) organohydrosiloxane copolymers such as (a) PS-122.5, (50–55%)methylhydro-(45–50%) dimethylsiloxane, (b) PS-123, (30–35%)methylhydro-(65–70%) dimethylsiloxane, (c) PS-123.5, (15–18%)methylhydro-(82–85%) dimethylsiloxane, (d) PS-124.5, (3–4%)methylhydro-(96–97%) dimethylsiloxane, (e) PS-123.8, (0.5–1.0%)methylhydro-(99.0–99.5%) dimethylsiloxane, (f) PS-124, (40–60%)methylhydro-(40–60%) methylcyanopropylsiloxane, (g) PS-125, (40–60%)methylhydro-(40–60%) methyloctylsiloxane, (h) PS-125.5, (25–30%)methylhydro-(70–75%) methyloctylsiloxane, (i) PS-128, methyldimethoxy terminated methylhydrosiloxane, and (j) PS-129.5, dimethylsiloxy terminated (45–50%) methylhydro-(50–55%)phenyl-methylsiloxane.

Preferred organopolysiloxanes include polymethylhydrosiloxanes and, more preferably, copolymers of at least two organohydrosiloxanes.

The Si—H functional groups are preferably present at a concentration within the range from 0.1 to 60 mole percent, more preferably, within the range from 1 to 10 mole percent. The viscosity of the Si—H functionalized organopolysiloxane can range from about 20 to 200,000 centistokes at 25° C., preferably about 100 to 60,000 centistokes, and more preferably about 200 to 2000 centistokes. In carrying out the process of this invention, two or more Si—H functionalized organopolysiloxane fluids can be used in admixture so as to provide particular viscosity and Si—H content to meet the specific demands of the particular fusing system. Non-functionalized silicone fluids can also be blended with the Si—H functionalized organopolysiloxane fluids for the purposes of obtaining balanced physical properties, cost benefits, or both.

The metal compound present in the wicking agent preferably comprises a metal salt, which may be complexed with an organic ligand. The metal is preferably selected from the group consisting of platinum, tin, zinc, and iron. Preferred metal salts include platinum perchlorate, platinum acetate, platinum octoate, tin perchlorate, tin acetate, tin octoate, zinc perchlorate, zinc acetate, zinc octoate, ferric perchlorate, ferric acetate, and ferric octoate, more preferably, platinum perchlorate, platinum acetate, platinum octoate, zinc octoate and tin octoate, and, most preferably, platinum perchlorate. Examples of useful organometallic complexes include platinum-divinyltetramethyldisiloxane complex, available from Petrarch Systems as Catalyst PC075, and platinum-cyclovinylmethylsiloxane complex, available from Petrarch Systems as Catalyst PC085. Examples of commercially available useful metal salts include zinc octoate, available from Petrarch Systems as Catalyst PC040, and tin octoate, available from Petrarch Systems as Catalyst PC050. As discussed in R. Anderson et al, *Silicon Compound Register and Review*, Petrarch Systems, 1987, pp 266–270, the disclosure of which is incorporated herein by reference, compounds of platinum, including organometallic complexes, are effective for promoting reaction between the Si—H groups of the organopolysiloxane included in the wicking agent and vinyl groups in the surface polymer of the fuser member. Metal compounds such as salts of iron, tin, and zinc are effective catalysts for the reaction of the organopolysiloxane Si—H groups with silanol groups on the fuser member surface.

The affinity of the Si—H functionalized organopolysiloxane for the surface of the fuser member is substantially increased by incorporating the metal salt in the wicking agent at a concentration of at least about $1\times10^{-6}$ weight percent. Preferably, the amount of metal compound included in the wicking agent is about $2\times10^{-6}$ to $1\times10^{-4}$ weight percent.

The wicking agents of this invention can be applied to any fuser member surface. "Fuser member" is used herein to refer to components of an electrophotographic fusing system that engage a toner carrying receiver and fix the toner to the receiver by means of elevated temperature or pressure. Examples of fuser members include fuser and pressure rollers, fuser and pressure plates, and fuser belts. The term fuser member is also used herein to refer to similar components similarly employed in non-electrophotographic equipment.

The fuser members typically comprise a support and a polymeric coating. The support can comprise metal, ceramic, or a polymeric material such as a thermoset resin, with or without fiber enforcement. The preferred fuser members are fuser and pressure rollers having a core for the support. The preferred core consists of a metal such as aluminum, nickel, or steel, most preferably, aluminum. The support can be coated with adhesion promoters, primers, and one or more polymeric layers. The fuser member polymeric surface material includes reactive sites such as, for example, hydroxyl and vinyl groups that undergo reaction with a Si—H functional group of an organopolysiloxane included in a wicking agent. Examples of materials that can be used to form the polymeric surface layers on the fuser members include fluoroelastomers, fluorosilicone rubbers, silicone rubbers, fluoropolymer resins, and interpenetrating networks of silicone polymers and fluoroelastomers.

Silicone rubber layers may comprise polymethyl siloxanes, such as EC-4952, available from Emerson Cummings, and Silastic™ J or E, available from Dow Corning. Fluorosilicone rubber layers include polymethyltrifluoropropylsiloxanes, such as Sylon, Fluorosilicone FX11293, and FX11299, available from 3M. The polymer layer on the fuser member may also comprise an interpenetrating network containing separately cross-linked silicone polymer and fluoroelastomer. Interpenetrating networks are disclosed in U.S. application Ser. No. 08/122,754, filed Sep. 16, 1993 as a continuation-in-part of U.S. application Ser. No. 07/940,582, filed Sep. 4, 1992; and U.S. application Ser. No. 08/250,325, now U.S. Pat. No. 5,534,347, issued Jun. 9, 1996, which was filed May 27, 1994 as a continuation-in-part of U.S. application Ser. No. 07/940,929, filed Sep. 4, 1992, the disclosures of all of which are incorporated herein by reference.

The polymeric layer of the fuser member may comprise inert fillers or other addenda. Examples of useful fillers include particulate filler or pigments comprising, for example, metals such as tin and zinc, metal oxides such as aluminum oxide and tin oxide, metal hydroxides such as calcium hydroxide, silicates, carbon, and mixtures thereof. The filler can be present in the surface layer from 0 to about 50 percent of the total volume of the layer. In preferred embodiments of the invention, the surface layer contains no metallic fillers.

The polymeric layer may be adhered to a metal component such as a core via a primer layer. The primer layer can comprise a primer composition that improves adhesion between the metal and the polymeric material. Primers for the application of fluoroelastomers, fluorosilicone rubbers and silicone rubbers to metal are known in the art. Such primer materials include silane coupling agents, which can be either epoxy-functionalized or amine-functionalized epoxy resins, benzoguanamine-formaldehyde resin crosslinker, epoxy cresol novolac, dianilinosulfone crosslinker, polyphenylene sulfide polyether sulfone, polyamide, polyimide and polyamideimide. Examples of commercially available primers for silicone rubbers and fluorosilicone rubbers include DC-1200, available from Dow Corning, and GE-4044, available from General Electric. Examples of commercially available primers for fluoroelastomers include Thixon 300 and Thixon 311, available from Morton Chemical Co.

A preferred surface layer of the fuser member for the application of the wicking agent of this invention is a fluoroelastomer layer comprising a cured fluorocarbon random copolymer having subunits with the following general structures:

$-(CH_2CF_2)_x-$ (vinylidene fluoride subunit ("VF")), $-(CF_2CF_2)_y-$ (tetrafluoroethylene subunit ("TFE")), and $-(CF_2\overset{CF_3}{\overset{|}{C}}F)_z-$ (hexafluoropropylene subunit ("HFP")).

In these formulas, x, y, and z are mole percentages of the individual subunits relative to a total of the three subunits (x+y+z), referred to herein as "subunit mole percentages". (The curing agent can be considered to provide an additional "cure-site subunit", but the contribution of these cure-site subunits is not considered in subunit mole percentages.) In the preferred fluorocarbon copolymers, x is about 42 to 58 mole percent, y is about 26 to 44 mole percent, and z is about 5 to 22 mole percent.

Preferred fluoroelastomers have subunit mole percentages in the ranges: x, from 47 to 56; y, from 21 to 39; z, from 10 to 22. More preferred materials have mole percentages in the ranges: x, from 50 to 55; y, from 25 to 35; z, from 13 to 22. In the most preferred fluoroelastomers, x, y, and z are selected such that fluorine atoms represent between 69 and 74, more preferably, 70 to 72 percent of the total formula weight of the VF, HFP, and TFE subunits. The fluoroelastomer is preferably a terpolymer of VF, HFP, and TFE subunits, the weight ratio of vinylidene fluoride to hexafluoropropylene in the terpolymer being from 1.06 to 1.6. The uncured fluoroelastomer preferably has a number average molecular weight in the range of about 10,000 to 200,000.

To form a fluoroelastomer layer, the uncured fluorocarbon polymer, crosslinking agent, and any other additives, for example, an accelerator or an acid acceptor type filler, are mixed to form a composite. The composite is applied over the support, with or without a base cushion layer, and cured. The crosslinking agent can be a basic nucleophile. Basic nucleophilic cure systems are well known and are discussed, for example, in U.S. Pat. No. 4,272,179, the disclosure of which is incorporated herein by reference. One example of such a cure system combines a bisphenol as the crosslinking agent and an organophosphonium salt, as an accelerator. Examples of bisphenol include 2,2-bis(4-hydroxyphenyl) hexafluoropropane, and 4,4-isopropylidenediphenol:

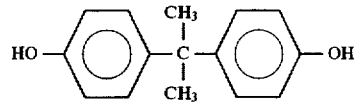

Examples of organophosphonium salts include halides such as benzyl triphenylphosphonium chloride:

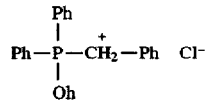

The crosslinking agent is incorporated into the polymer as a cure-site subunit, for example, bisphenolic residues. Other examples of nucleophilic addition cure systems are sold commercially as DIAK No. 1 (hexamethylenediamine carbamate) and DIAK No. 3 (N,N'-dicinnamylidene-1,6-hexanediamine) by E. I. duPont de Nemours & Co. Nucleophilic addition-cure systems used in conjunction with fluorocarbon polymers can generate hydrogen fluoride, and thus acid acceptors are added as fillers. Suitable acid acceptors include Lewis bases such as metal oxides or hydroxides, for example, magnesium oxide, calcium hydroxide, lead oxide, copper oxide and the like. It is preferred to use 3 parts MgO and 6 parts $Ca(OH)_2$ per 100 parts of fluoroelastomer as acid acceptors in the fluoroelastomer layer composition.

Other conventional cure or crosslinking systems containing free radical initiators may be used to cure fluoroelastomers, for example, organic peroxides such as dicumylperoxide and dichlorobenzoyl peroxide. 2,5-Dimethyl-2,5-di-t-butylperoxyhexane with triallyl cyanurate may also be used; however, nucleophilic addition systems are preferred.

Preferred solvents for the fluoroelastomer composites are the ketones, especially methyl ethyl ketone (MEK) and methyl isobutyl ketone. The preferred solvent is a blend of MEK and methanol, most preferably 85:15 by weight MEK:methanol. The composites are dispersed in the coating solvent at a concentration of between about 10 to 50 weight percent, preferably between about 20 to 30 weight percent, and coated on the fuser member to a thickness, after drying, of about 0.025 to 0.25 micron. The coated article is then cured.

Curing of the fluoroelastomer layer is carried out according to the well known conditions for curing fluoroelastomers ranging, for example, from about 12 to 48 hours at temperatures between about 50° C. and 250° C. Preferably, the coated fluoroelastomer layer is dried until solvent free at room temperature, then gradually heated to about 230° C. over 24 hours, and maintained at that temperature for 24 hours. The thickness of the fluoroelastomer layer is preferably about 0.025 to 0.25 micron if another polymeric layer is present on the support of the fuser member, and about 0.25 to 5 microns if the fluoroelastomer layer is applied to the support without the presence of another polymeric layer.

The supports for the fuser members can be coated with the fluoroelastomer composite or other polymeric materials by conventional techniques, such as dip, spray, ring or blade coating. Coating solvents that can be used include polar solvents, for example, ketones, acetates and the like.

Suitable uncured fluoroelastomers useful in this invention are available commercially. Fluorocarbon polymers useful for the surface layer include vinylidene fluoride-co-hexafluoropropylene-co-tetrafluoroethylene (x=52, y=34, z=14), available under the trade name Fluorel FX-9038 from Minnesota Mining and Manufacturing (3M), and vinylidene fluoride-co-hexafluoropropylene-co-tetrafluoroethylene (x=53, y=26, z=21), available under the trade name FE-5840Q from 3M. Other fluoroelastomers include VITON A and B, available from duPont, and Fluorel FX-2530, available from 3M. The wicking agent can be applied to a pretreated or untreated fuser member. The preferred pretreatment is described by Chen et al. in U.S. application Ser. No. 08/681,562 entitled, "Method of Fusing Heat Softenable Toner Images" filed Jul. 29, 1996, which is a continuation-in-part of U.S. application Ser. No. 08/216,200, having the same title, filed Mar. 22, 1994, abandoned, which is a continuation-in-part of U.S. application Ser. No. 07/919,669, having the same title, filed Jul. 27, 1992, abandoned, the disclosures of all of which are incorporated herein by reference. Prior to its installation in an electrostatographic machine, a fluoroelastomer outer layer of a fuser member is treated with a release agent that may have a composition the same as or similar to the wicking agent. The fuser member is then incubated, preferably for about 1 to 60 hours at a temperature of about 100° C. to 250° C., more preferably for about 4 to 40 hours at about 125° C. to 200° C., and most preferably for about 8 to 24 hours at about 160° C. to 190° C.

In the electrostatographic machine, wicking agent is continuously or discontinuously applied to the pretreated fuser member. The wicking agent provides a replaceable layer that is at least partially removed by toner-bearing receivers as they pass through the fuser system to fix the toner to the receiver. The wicking agent is applied to at least one of the fuser members in the fusing system, preferably to the fuser roller that contacts the toner bearing side of the receiver. Any suitable method and devices known to a person of ordinary skill in the art can be used to apply the wicking agent to the fuser member. For example, wicking agent can be applied to the fuser member by oil donor rollers or rotating wick rollers and the like. The donor rollers can receive wicking agent from a metering roller, which in turn receives wicking agent from a wick or from a bath or reservoir of wicking agent. The amount of wicking agent supplied to the metering roller can be limited by a metering blade or by the characteristics of the wick. The wick can receive wicking agent from a wicking agent reservoir by capillary action or by the action of a pump. In alternative examples, the wicking agent can be supplied to the fuser member directly by a wicking roller. The preferred wicking roller has a wick that supplies wicking agent to a roller core that is permeable to the wicking agent. The preferred wick is a poly(methylphenylene isophtalate) NOMEX wick, available from DuPont. The wicking agent can also be supplied to the fuser member by pads or spraying devices.

The wicking agent applied by the method of this invention preferably is present on the fuser member surface layer at a thickness of about 0.5 to 40 nanometers (nm), more preferably about 2 to 15 nm, most preferably about 5 to 10 nm.

The wicking agent present on the fuser member has a percentage atomic Si, as determined by X-ray photoelectron spectroscopy, of at least 10 percent, more preferably at least 15 percent, and most preferably at least 20 percent.

The wicking agent of this invention applied to fuser members is useful for fusing heat-softenable toner materials of all types having the physical properties required in dry electrostatographic toner materials. Such toner materials or particles can be thermally fixed or adhered to a receiver such as paper or plastic. These thermal fixing techniques are well known in the art.

Many polymers have been reported in the literature as being useful in dry electrostatographic toners. Polymers useful in such toners include vinyl polymers, for example, homopolymers and copolymers of styrene, and condensation polymers such as polyesters and copolyesters. Fusible styrene-acrylic copolymers that are covalently lightly crosslinked with a divinyl compound such as divinylbenzene, as disclosed in the patent to Jadwin et al. U.S. Reissue Pat. No. 31,072, are useful. Also useful are polyesters of aromatic dicarboxylic acids with one or more aliphatic diols, such as polyesters of isophthalic or terephthalic acid with diols such as ethylene glycol, cyclohexanedimethanol and bisphenols. Examples are disclosed in the patent to Jadwin et al.

Fusible toner particles used in this invention can have fusing temperatures in the range from about 500° C. to 2000° C. so they can readily be fused to paper receivers. Preferred toners are fusible in the range of about 65° C. to 120° C. If the toner transfer is made to receivers that can withstand higher temperatures, polymers with higher fusing temperatures can be used.

Toner particles can comprise simply the polymeric particles, but it is often desirable to incorporate addenda such as waxes, colorants, release agents, charge control agents, and other addenda well known in the art in the polymeric particles.

Suitable colorants selected from a wide variety of dyes and pigments such as disclosed, for example, in U.S. Reissue Pat. No. 31,072 can be used. A particularly useful colorant for toners is carbon black. Colorants in the amount of about 1 to about 30 percent of the weight of the toner can be used. Preferably, about 1 to 8 weight percent of colorant is employed.

Charge control agents suitable for use in toners are disclosed, for example, in U.S. Pat. Nos. 3,893,935; 4,079,014; and 4,323,634; and in British Patent Nos. 1,501,065 and 1,420,839. Charge control agents are generally employed in small quantities, about 0.1 to about 3 percent, preferably about 0.2 to 1.5 percent, based on the weight of the toner.

Toners can be mixed with a carrier vehicle. The carrier vehicles, which can be used to form suitable developer compositions, can be selected from a variety of materials. Such materials include carrier core particles and core particles overcoated with a thin layer of film-forming resin. Examples of suitable resins are described in U.S. Pat. Nos. 3,547,822; 3,632,512; 3,795,618; 3,898,170; 4,545,060; 4,478,925; 4,076,857; and 3,970,571. The carrier core particles can comprise conductive, non-conductive, magnetic, or non-magnetic materials, as disclosed, for example, in U.S. Pat. Nos. 3,850,663 and 3,970,571. Especially useful in magnetic brush development schemes are iron particles, for example, porous iron particles having oxidized surfaces, steel particles, and other "hard" or "soft" ferromagnetic materials such as gamma ferric oxides or ferrites, for example, ferrites of barium, strontium, lead, magnesium, or aluminum. See, for example, U.S. Pat. Nos. 4,042,518; 4,478,925; and 4,546,060.

A typical developer composition containing toner particles and carrier vehicle generally comprises about 1 to 20 weight percent of toner particles and from 60 to 99 weight percent, by weight, of carrier particles. Usually, the carrier particles are larger than the toner particles. Conventional carrier particles have a particle size on the order of about 20 to 1200 microns, generally about 30 to 300 microns. Alternatively, the toners can be used in a single component developer, i.e., with no carrier particles.

Typical toner particles generally have an average diameter in the range of about 0.1 to 100 microns, diameters of about 2 to 20 microns being particularly useful in many current copy machines.

The invention is further illustrated by the following examples.

EXAMPLES

The affinity of the wicking agents of this invention to heated fuser member surfaces in the process of the present invention can be assessed from the results of applying wicking agents comprising polyorganosiloxanes and metal compounds to a fuser member surface comprising, for example, a fluoroelastomer, incubating the fuser member for 8 hours at 170° C. in contact with the wicking agent, and then subjecting the fluoroelastomer surface to repeated washings with dichloromethane to remove unreacted wicking agent. Quantitative measurements of the attachment of the polyorganosiloxane to the surface of the fluoroelastomer were carried out by X-ray photoelectron spectroscopy.

The fluoroelastomer surface was a VITON A copolymer composition prepared as follows: One hundred parts of VITON A copolymer (copolyhexafluoropropylenevinylidene fluoride) having a number-average molecular weight of 100,000 (available from E. I. duPont & Co.), 20 parts of lead monoxide, 20 parts of carbon black (Stainless Thermax N 990 from R. T. Vanderbilt Co.), 6 parts of the cross-linking agent hexafluoroisopropylidenediphenol, and 2.5 parts of the cure accelerator triphenylbenzylphosphonium chloride were thoroughly compounded on a two-roll mill until a uniform and smooth sheet was obtained. Part of the sheet was cut into small pieces and dissolved in methyl ethyl ketone to form a 20% coating dispersion, which was hand-coated on a 2-mil stainless steel shim, air dried for 24 hours, ramped to 232° C. over a 24-hour period, and cured at 232° C. for 24 hours.

The coated stainless steel was cut into small pieces and a drop of wicking agent was applied to each piece and uniformly spread over the surface thereof. After incubation at 170° C. for 8 hours, followed by washing with dichloromethane, the values for atomic percent silicon and atomic percent fluorine were determined by X-ray photoelectron spectroscopy.

The results obtained are reported in Table I below which also describes the polyorganosiloxane fluid(s) used and the amount of metal compound included in the wicking agent.

TABLE I

| Example | Organopolysiloxane | (Metal Compound* Weight %) | % Si | % F |
|---|---|---|---|---|
| Control 1 | None | 0 | 2.7 | 40.2 |
| Control 2 | Silicone Fluid DC-200** | 0 | 8.1 | 27.1 |
| Control 3 | Silicone Fluid F655B*** | 0 | 20.8 | 5.5 |
| Control 4 | PS-542 | 0 | 11.9 | 19.5 |
| Control 5 | PS-123.8 | 0 | 24.4 | 2.2 |
| Control 6 | PS-124.5 | 0 | 13.7 | 17.2 |
| 1 | PS-123.8 | $1.2 \times 10^{-6}$ | 24.9 | 1.6 |
| 2 | PS-123.8 | $6.0 \times 10^{-7}$ | 24.3 | 2.4 |
| 3 | PS-123.8 | $1.2 \times 10^{-7}$ | 24.0 | 3.1 |
| 4 | PS-124.5 | $1.2 \times 10^{-6}$ | 16.1 | 13.5 |
| 5 | PS-124.5 | $6.0 \times 10^{-7}$ | 13.3 | 17.9 |
| 6 | PS-124.5 | $1.2 \times 10^{-7}$ | 13.4 | 17.1 |

*The metal compound was PC075, a platinum organometallic complex catalyst available from Petrarch Systems

**Silicone Fluid DC-200 is a non-functionalized trimethylsiloxane-terminated polydimethylsiloxane fluid available from Dow-Corning Chemical Co.

***Silicone Fluid F-655B is a mercapto-functionalized polydimethylsiloxane (0.089%-SH by weight) available from Stauffer-Wacker Silicone Corp.

For a surface totally covered with polydimethylsiloxane, the calculated percentage of atomic Si is 25%. Referring to Table I, the non-functionalized polyorganosiloxane DC-200 provided a percentage of atomic Si of only 8.1%. Use of the Si—H functionalized polyorganosiloxane PS-123.8 ($M_w$ 63,000, viscosity 10,000 cSt) with $1.2\times10^{-6}$ weight percent of metal compound provided an increase in the percentage of atomic Si from 24.4 to 24.9%, as shown by the results for Example 1 and Control 5 in Table 1. The mercapto-functionalized polyorganosiloxane F-655B provided a percentage atomic Si value of 20.8% (Control 3), but this material suffers from the disadvantages of unpleasant odor and toxicity, as previously described. Thus, results as good or better than those obtained with the mercapto-functionalized polyorganosiloxane can be obtained by use of a wicking agent comprising a Si—H functionalized polyorganosiloxane and a suitable metal compound, in accordance with the invention.

The use of a reaction-promoting metal compound in the wicking agent is especially beneficial with lower molecular weight Si—H functionalized organopolysiloxanes. A substantial improvement in the Si percentage, 16.1% vs 13.3%, resulted when an effective amount of the metal compound catalyst was used with PS-124.5 fluid ($M_w$ 13,000, viscosity 250 cSt), as shown by the results for Example 4 and Control 6. The beneficial effect attainable with wicking agents containing low molecular weight, low viscosity organopolysiloxanes is important because it facilitates the pumping and metering of the wicking agent to the fuser member surface.

The high affinity of Si—H functionalized organopolysiloxanes containing at least $1\times10^{-6}$ weight percent of a reaction-promoting metal compound for fuser member surfaces provides excellent release of fused toner images. The process of the invention provides a highly effective way of meeting the need for excellent release characteristics without excessive wear of the fuser member and without encountering the problems of odor and toxicity associated with prior use of mercapto-functional polydiorganosiloxanes.

The invention has been described in detail with particular reference to preferred embodiments thereof, but it will be understood that variations and modifications can be effected within the spirit and scope of the invention.

What is claimed is:

1. A process for fusing a toner image to a substrate comprising:

applying to a fuser member surface a replenishable layer comprising a controlled amount of a wicking agent, said fuser member surface comprising sites reactive to binding with Si—H functional groups included in a organopolysiloxane, said wicking agent comprising an organopolysiloxane having Si—H functional groups and at least about $1\times10^{-6}$ weight percent of a metal compound that is effective for promoting reaction between said reactive sites on said fuser member surface and said Si—H functional groups in said organopolysiloxane; and pressure contacting a toner image with a substrate by said fuser member surface at a temperature effective to fuse said toner image to said substrate.

2. The process of claim 1 wherein said metal compound is present in said wicking agent in an amount of about $2\times10^{-6}$ to $1\times10^{-4}$ weight percent.

3. The process of claim 1 wherein said Si—H functional groups are present in said organopolysiloxane at a concentration of about 0.1 to 60 mole percent.

4. The process of claim 3 wherein said Si—H functional group concentration is about 1 to 10 mole percent.

5. The process of claim 1 wherein said organopolysiloxane has a viscosity of about 20 to 200,000 centistokes at 25° C.

6. The process of claim 5 wherein said organopolysiloxane has a viscosity of about 200 to 2,000 centistokes at 25° C.

7. The process of claim 1 wherein said organopolysiloxane has the formula:

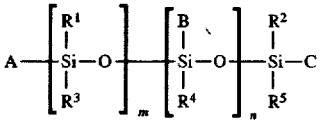

wherein $R^1$, $R^2$, $R^3$, $R^4$, and $R^5$ are independently selected from the group consisting of alkyl containing 1 to 10 carbon atoms, cycloalkyl containing 5 to 10 carbon atoms, alkoxy containing 1 to 10 carbon atoms, and phenyl, A, B, and C are independently selected from the group consisting of hydrogen, alkyl containing 1 to 10 carbon atoms, and alkoxy containing 1 to 10 carbon atoms, provided that at least one of A, B or C is hydrogen, and m and n are percentages each between b 1and 99 percent.

8. The process of claim 7 wherein B is hydrogen and A and C are each alkyl.

9. The process of claim 1 wherein said organopolysiloxane is selected from the group consisting of a polymethylhydrosiloxane and a copolymer of at least two organohydrosiloxanes.

10. The process of claim 1 wherein said metal compound is a salt of a metal selected from the group consisting of platinum, tin, zinc, and iron.

11. The process of claim 10 wherein said metal compound is selected from the group consisting of platinum perchlorate, platinum acetate, platinum octoate, tin perchlorate, tin acetate, tin octoate, zinc perchlorate, zinc acetate, zinc octoate, ferric perchlorate, ferric acetate, and ferric octoate.

12. The process of claim 11 wherein said metal compound is selected from the group consisting of platinum perchlorate, platinum acetate, platinum octoate, tin octoate, and zinc octoate.

13. The process of claim 12 wherein said metal compound is present in said wicking agent in the range of about $1\times10^{-6}$ to $1\times10^{-4}$ weight percent.

14. The process of claim 1 wherein said metal compound is a platinum organometallic complex.

15. The process of claim 1 wherein said replenishable layer of wicking agent has a thickness of about 0.5 to 40 nanometers.

16. The process of claim 1 wherein said organopolysiloxane is an admixture of at least two Si—H functionalized organopolysiloxane fluids.

17. The process of claim 1 wherein said wicking agent further comprises a silicone fluid free of Si—H functional groups.

18. The process of claim 1 wherein applying said wicking agent provides a percentage of atomic Si on said fuser member surface of about 16 to 25 percent.

19. The process of claim 1 wherein said fuser member surface comprises a material selected from the group consisting of a fluoroelastomer, a fluorosilicone rubber, a silicone rubber, a fluoropolymer resin, and an interpenetrating network of a silicone polymer and a fluoroelastomer.

20. The process of claim 19 wherein said material is a fluoroelastomer.

21. A wicking agent for use with a fuser member having a surface comprising sites reactive to binding with Si—H functional groups to fuse a toner image to a substrate, said wicking agent comprising:

an organopolysiloxane comprising Si—H functional groups; and at least about $1\times10^{-6}$ weight percent of a metal compound that is effective for promoting reaction between said fuser member surface and said organopolysiloxane Si—H functional groups.

22. The wicking agent of claim 21 wherein said metal compound is a salt of a metal selected from the group consisting of platinum, tin, zinc, and iron.

23. The wicking agent of claim 22 wherein said metal compound is selected from the group consisting of platinum perchlorate, platinum acetate, platinum octoate, tin perchlorate, tin acetate, tin octoate, zinc perchlorate, zinc acetate, zinc octoate, ferric perchlorate, ferric acetate, and ferric octoate.

24. The wicking agent of claim 22 wherein said metal compound is a platinum organometallic complex.

25. The wicking agent of claim 21 wherein said organopolysiloxane has the formula:

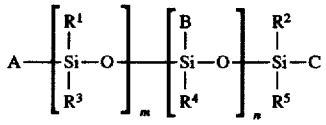

wherein $R^1$, $R^2$, $R^3$, $R^4$, and $R^5$ are independently selected from the group consisting of alkyl containing 1 to 10 carbon atoms, cycloalkyl containing 5 to 10 carbon atoms, alkoxy containing 1 to 10 carbon atoms, and phenyl, A, B, and C are independently selected from the group consisting of alkyl containing 1 to 10 carbon atoms and alkoxy containing 1 to 10 carbon atoms, provided that at least one of A, B, or C is hydrogen, and m and n are percentages each between 1 and 99 percent.

26. The wicking agent of claim 25 wherein B is hydrogen and A and C are each alkyl.

27. The wicking agent of claim 21 wherein said organopolysiloxane is selected from the group consisting of a polymethylhydrosiloxane and a copolymer of at least two organohydrosiloxanes.

28. The wicking agent of claim 21 wherein said organopolysiloxane has a viscosity of about 200 to 2,000 centipoises at 25° C.

* * * * *